US009378937B2

(12) United States Patent
Kollmer et al.

(10) Patent No.: US 9,378,937 B2
(45) Date of Patent: Jun. 28, 2016

(54) MASS SPECTROMETER AND LIQUID-METAL ION SOURCE FOR A MASS SPECTROMETER OF THIS TYPE

(75) Inventors: Felix Kollmer, Altenberge (DE); Peter Hoerster, Muenster (DE)

(73) Assignee: ION-TOF TECHNOLOGIES GmbH, Muenster (DE)

( * ) Notice: Subject to any disclaimer, the term of this patent is extended or adjusted under 35 U.S.C. 154(b) by 870 days.

(21) Appl. No.: 10/568,832

(22) PCT Filed: Jul. 1, 2004

(86) PCT No.: PCT/EP2004/007154

§ 371 (c)(1),
(2), (4) Date: Feb. 17, 2006

(87) PCT Pub. No.: WO2005/029532

PCT Pub. Date: Mar. 31, 2005

(65) Prior Publication Data

US 2006/0202130 A1 Sep. 14, 2006

(30) Foreign Application Priority Data

Aug. 25, 2003 (DE) ..... 103 39 346

(51) Int. Cl.
*H01J 49/00* (2006.01)
*H01J 49/16* (2006.01)
(Continued)

(52) U.S. Cl.
CPC ..... *H01J 49/16* (2013.01); *H01J 27/26* (2013.01); *H01J 49/40* (2013.01)

(58) Field of Classification Search
USPC ..... 250/423 R
See application file for complete search history.

(56) References Cited

U.S. PATENT DOCUMENTS 3,508,045 A * 4/1970 Liebl et al. ..... 250/282
4,019,989 A 4/1977 Hazewindus et al.
(Continued)

FOREIGN PATENT DOCUMENTS

JP 03084435 A 4/1991
JP 03155025 7/1991
JP 11274255 10/1999

OTHER PUBLICATIONS

J. Van De Walle and P. Joyes, Study of Binp+ ions formed in liquid-metal ion sources, Apr. 15, 1987, Physical Review, v. 35, pp. 5509-5513.*

(Continued)

*Primary Examiner* — Phillip A Johnston
(74) *Attorney, Agent, or Firm* — Karl F. Milde, Jr.; Eckert Seamans Cherin & Mellott, LLC

(57) ABSTRACT

A mass spectrometer includes an ion source for producing a primary ion beam, which has a heatable ion emitter coated by a liquid metal layer essentially comprised of pure metallic bismuth or of a low-melting-point alloy containing, in essence, bismuth. A bismuth ion mixed beam can be emitted by the ion emitter under the influence of an electric field. From said bismuth ion mixed beam, one of a number of bismuth ion types whose mass is a multiple of monatomic singly or multiply charged bismuth ions $Bi_1^{p+}$, is to be filtered out in the form of a mass-pure ion beam that is solely comprised of ions of a type $Bi_n^{p+}$, in which n≥2 and p≥1, and n and p are each a natural number.

7 Claims, 2 Drawing Sheets

(51) Int. Cl.
*H01J 27/26* (2006.01)
*H01J 49/40* (2006.01)

(56) References Cited

U.S. PATENT DOCUMENTS

| | | | | |
|---|---|---|---|---|
| 4,426,582 | A * | 1/1984 | Orloff | H01J 37/04 250/281 |
| 4,686,414 | A | 8/1987 | McKenna et al. | |
| 5,633,495 | A * | 5/1997 | Niehuis | 250/287 |
| 6,002,128 | A | 12/1999 | Hill et al. | |
| 6,291,820 | B1 * | 9/2001 | Hamza et al. | 250/282 |
| 6,791,078 | B2 * | 9/2004 | Giles et al. | 250/286 |
| 6,989,528 | B2 * | 1/2006 | Schultz | H01J 49/0031 250/281 |
| 2006/0183235 | A1 * | 8/2006 | Hashimoto et al. | 436/86 |

OTHER PUBLICATIONS

Barofsky, "Liquid Metal Ion Sources", Desorption Mass Spectrometry; Lyon, P.; ACS Symposium Series; American Chemical Society: Washington, DC, 1985.*

Barofsky, "Liquid Metal Ion Sources", Desorption Mass Spectrometry; Lyon, P.; ACS Symposium Series; American Chemical Society: Washington, DC, 1985, pp. 113-122.*

Liquid Metal Gold Cluster Ion Gun for Improved Molecular Spectroscopy and Imaging, published 2002. ION-TOF GmbH, Muenster Germany.

Cluster Formation Under Bombardment with Polyatomic Projectiles, R. Heinrich, A. Wucher, Elsevier Science B.V., 2000, pp. 720-726.

Cluster Impacts at keV and MeV Energies: Secondary Emission Phenomena, Yvon Le Beyec, Elsevier Science B.V., 1998, pp. 101-117.

Study of BinP+ Ions Formed in Liquid-Metal Ion Sources, Physical Review B, XP-002366516, vol. 35, No. 11, Apr. 15, 1987, pp. 5509-5513.

Spike Effects in Heavy-Ion Sputtering of Ag, Au and Pt Thin Films, S.S. Johar and D.A. Thompson, Surface Science XP-002366490 (1979) 319-330.

L.W. Swanson, "Use of the liquid Metal Ion Source for Focused Beam Applications", Appl., Surf. Sci., 76/77 (1994) 80-88, 1993; (D1).

J. Schwieters, et al., "High Mass Resolution Surface Imaging With a Time-Of-Flight Secondary Ion Mass Spectroscopy Scanning Microprobe", J. Vac. Sci. Technol. A (6) (Nov./Dec. 1.

A. Walker, N. Winograd, "Prospects for Imaging withTOF-SIMS Using Gold Liquid Metal Ion Sources", Applied Surface Science, 203•203 (2003) 198-200, Jan. 15, 2003; (D3).

N. Davies, D.E. Weibel, P. Plenklnsopp, N. Lockyer, R. Hill, J.E. Vickerman, Development and Experimental Application of a Gold Liquid Metal Ion Source, Applied Surface Scien.

"IONTOF Company History", http://www.ion-tof.com/company-history-IONTOF-TOF-SIMS-TIME-OF-FLIGHT-SURFACE-ANALYSIS.htm, retrieved on Apr. 3, 2009.

"Non-Linear Sputtering Effects in Thin Metal Films"; D.A. Thomson and S. S. Johar; Appl. Phys. Lett 34(5), Mar. 1, 1979; pp. 342-344.

Iosif S. Bitensky and Douglas F. Barofsky, Nonlinear effects in sputtering of organic liquids by keV ions Physical Review B vol. 56, No. 21, pp. 13815-13825 (1997).

FIB / Ion Milling technique Q&A for researchers of electronic microscope—a booster of nano-technology—Author name (Joint editor) : Masao Hirasaka and Kentaro Asakura, Publisher : Agne-Shofu-Sha.

N. Davies et al., "Development and Experimental Application of a Gold Liquid Metal Ion Source", Applied Surface Science 203-204 (2003), pp. 223-227.

www.iontof.com/dual-source-column-o2-cs-depth-profiling.html, "High-End Depth Profiling"; Jul. 1, 2015.

John C. Vickerman and David Briggs, "ToF-Sims: Surface Analysis by Mass Spectrometry", IM Publications.

A. Benninghoven, "Ion Formation from Organic Solids"; Proceedings of the Second International Conference, Muenster, Germany, Sep. 7-9, 1982, pp. 64-89.

Yvon Ie Beyec, "Cluster Impacts at keV and meV Engergies: Secondary Emission Phenomena", Elsevier Science B.V., International Journal of Mass Spectrometry and Ion Processes, 174 (1988) 101-117.

* cited by examiner

MASS SPECTROMETER AND LIQUID-METAL ION SOURCE FOR A MASS SPECTROMETER OF THIS TYPE

BACKGROUND OF THE INVENTION

The invention concerns a mass spectrometer for analysis of secondary ions and post-ionized neutral secondary particles with an ion source for creating a primary ion beam to irradiate a sample, and to produce secondary particles. The source possesses a heatable ion emitter that is coated in the area exposed to the field with a liquid-metal layer that contains an ionizable metal that is emitted and ionized as the primary ion beam. The primary ion beam contains metal ions with various stages of ionization and cluster statuses. In particular, the invention concerns a spectrometer unit for mass analysis of the secondary particles as well as the ion source of such a mass spectrometer.

In the description below, the conventional designation will be used for ions in clusters related to their mass and charge status, thus:

$$Bi_n^{p+}$$

wherein n=the quantity of atoms in a cluster, and p+=charge status.

It is known to use liquid metal sources in secondary-ion mass spectroscopy in particular when operated as time-of-flight secondary-ion mass spectroscopy (TOF-SIMS). Applicants have proposed a liquid metal gold-cluster ion source for a spectrometer (see prospectus: *Liquid Metal Gold Cluster Ion Gun for Improved Molecular Spectroscopy and Imaging, published* 2002) that represents the state of the art for the overall TOF-SIMS concept.

The efficiency of TOF-SIMS measurements with respect to primary ion beams from mono-atomic Gallium ions could be significantly increased using Gold Primary Clusters, e.g., of type $Au_3^+$. The disadvantage of the use of Gold as the material for the primary ion beam is that when Gold ions are created, those of type $Au_1^+$ predominate, while cluster formats such as $Au_2^+$ or $Au_3^+$ provide only low components of the overall ion current.

Bismuth has been used successfully during the intensive search for additional cluster-forming substances, containing only one natural isotope for secondary-ion mass spectroscopy. Bismuth is an an-isotopic element with a melting point of 271.3° C. Additionally, Bismuth alloys such as Bi+Pb, Bi+Sn, and Bi+Zn are known that possess lower melting points (46° C.-140° C.) than pure Bismuth. Pure Bismuth, however, is given preference for a liquid metal ion source.

In U.S. Pat. No. 6,002,128 it is noted that Bismuth is suited for the creation of charged particles. However, neither cluster formation nor the option of a liquid metal ion source with Bismuth is described. Also, the Japanese Patent No. 03-084435 proposes a calibration alloy for a secondary-ion mass spectrometer with which mass spectra with high resolution may be obtained. For this, the elements V, Ge, Cd, Os, and Bi are named as elements with high negative secondary ionization. The isotope patterns for the above-mentioned elements provide characteristic, repeatable spectra. However, this document does not mention cluster formation of a liquid metal ion source. Also, it is not indicated that Bismuth is well suited for cluster formation.

SUMMARY OF THE INVENTION

It is therefore an objective of the invention to develop an ion source for the operation of secondary-ion mass spectrometers with improved yield of cluster ions in order to achieve a high degree of efficiency of secondary ion formation with a simultaneous high data rate, and thereby short analysis times. The proposed improvement combines a high degree of efficiency E for secondary ion formation from unaltered sample surfaces with high cluster streams, and leads to a corresponding reduction of analysis times.

This objective is achieved by a secondary ion mass spectrometer, and by the concomitant ion source based on the above-mentioned overall concept, in which the liquid metal film consists of pure Bismuth, or of a Bismuth alloy with low melting point, whereby a Bismuth ion mixed beam is emittable from the ion emitter under the influence of an electric field. From this mixed beam, one of several types of Bismuth ions, whose mass comprises a multiple of the mono-atomic, singly- or multiply-charged Bismuth ions $Bi_1^{p+}$, may be filtered out using a filtering device as a mass-pure ion beam that consists exclusively of ions of the type $Bi_n^{p+}$ for which N≥2 and p≥1, and n and p are natural numbers.

Since secondary ion mass spectrometry involves the sputtering of a solid state surface to be analyzed, a portion of the surface is destroyed. Therefore, only a limited quantity of molecular secondary particles may be generated and determined from a given solid state surface. Particularly, the molecular components of the solid state surface decay from the primary ion irradiation, and therefore are not available to the analysis. Broader use of TOF-SIMS for analysis of molecular surfaces requires an increase in the previously achievable level of sensitivity determination for organic materials. Such a sensitivity increase requires efficient formation of secondary particles, particularly secondary ions, from thicker organic layers. The proposed improvement will increase the efficiency E of the secondary ion formation of unaltered sample surfaces.

The value E of the efficiency corresponds to the quantity of secondary particles determined by the spectrometer that may be determined per surface-area unit of a completely consumed monolayer. The quantity of secondary ions to be determined during small-surface chemical analysis under the selected irradiation conditions may resultantly be calculated from the efficiency.

It is particularly advantageous if the ions filtered out for a mass-pure ion beam belong to one of the following types: $Bi_2^+$, $Bi_3^+$, $Bi_3^{2+}$, $Bi_4^+$, $Bi_5^+$, $Bi_6^+$, $Bi_5^{2+}$, or $Bi_7^{2+}$. One should preferably work with an ion type that comprises a relatively large component of the total quantity of ions.

The mass spectrometer is preferably operated as a time-of-flight secondary ion mass spectrometer, since much experience exists for this type, and experimental operations have shown that there is great application potential here.

For Bismuth coating, an ion emitter equipped with a nickel-chromium tip presents a favorable choice according to the current state of the art with respect to its wettability, stability under load, and capability of being machined.

Mean current strength for the emission beam in the operation of a secondary ion mass spectrometer is selected to be between $10^{-8}$ and $5\times10^{-5}$ A.

For the case in which a metallic alloy of Bismuth is used instead of pure Bismuth, one with high Bismuth content and therefore low melting point is preferably selected. For example, this includes Bismuth alloys with one or several of the following metals as liquid metal coating: Ni, Ag, Pb, Hg, Cu, Sn, or Zn, whereby an alloy is preferably selected whose melting point lies below that of pure Bismuth.

For a full understanding of the present invention, reference should now be made to the following detailed description of the preferred embodiments of the invention as illustrated in the accompanying drawings.

Figure 1:
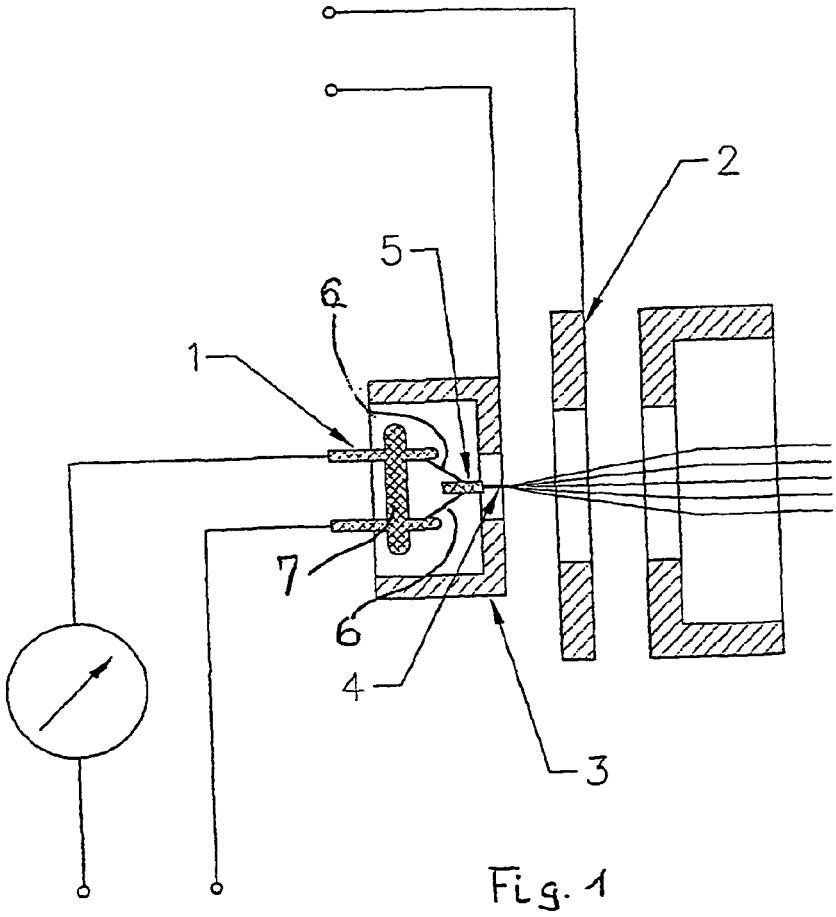
FIG. 1 is a diagram of the structure of a system to create a liquid metal ion source.

DESCRIPTION OF THE PREFERRED EMBODIMENTS The preferred embodiments of the present invention will now be described with reference to FIGS. 1-3 of the drawings.

Identical elements in the various figures are designated with the same reference numerals.

The general structure of a TOF-SIMS is generally known, so that reference will be made here only to FIG. 1 and the concomitant description from applicants' published German Patent Application No. DE 44 16 413 A1.

FIG. 1 shows a liquid metal ion source suitable for a TOF-SIMS. Liquid metal ion sources enjoy broad application in materials processing and surface analysis. These ion sources possess a very small virtual source size of about 10 nm, and a high degree of angular intensity. These characteristics allow liquid metal ion sources to be accurately focused whereby beam diameters down to 7 nm may be achieved for relatively high beam flow.

FIG. 1 schematically shows the system for creating ions from a liquid metal ion source with an emitter unit 1. The carrier unit 7 bears a stiff supply wire 6 on each of its ends whereby adjustable heating current is provided via the supply wires 6. Both supply wires 6 are connected to a reservoir 5 in which a supply of molten Bismuth is located during operation of the emitter unit 1. An emitter needle 4 extends from the center of the reservoir 5. The emitter needle 4 may thus be held at a temperature at which the Bismuth remains molten and moistens the needle.

The emitter needle 4 consists of a Nickel-Chromium alloy, and is moistened by liquid Bismuth to its tip. The emitter needle possesses a wire diameter of about 200 μm and a curvature radius at its tip of 2 to 4 μm. The emitter needle 4 is positioned at the center in front of an extraction screen 2, and is surrounded by a suppression unit 3.

If one applies high voltage between the extraction screen 2 and the moistened emitter needle 4, then a sharp cone of liquid Bismuth—the so-called "Taylor cone"—is formed on the needle tip beginning at a specific voltage. The taper of the tip connected with this leads to a clear increase in field strength. If the field strength is adequate for field desorption, the emission of metal ions begins at the tip of the Taylor cone. The emission current from the liquid metal ion source of the type shown lies approximately between 0.2 and 5 μA.

Figure 2:
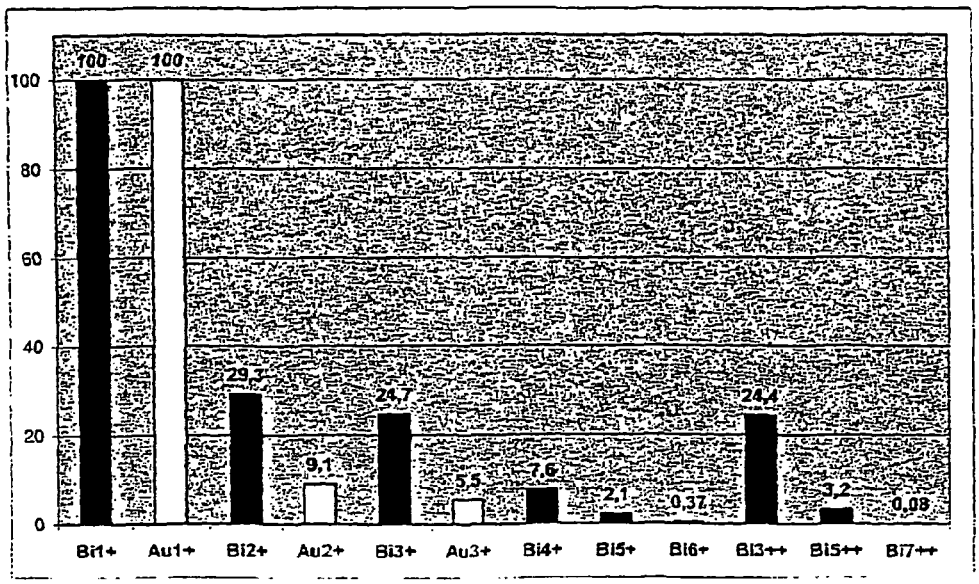
FIG. 2 is a chart comparing emission-current components standardized to the atomic, singly-laden species $Bi_1^+$ or $Au_1^+$ for corresponding emitters at an emission current of 1 μA.

FIG. 2 shows the components of emission current for Bismuth and Gold, standardized to the atomic, singly-charged ions for AuGe and Bi emitters at an emission current level of 1 μA.

It must be recognized that the standardized relative emission components turn out better for Bismuth than for Gold. Another advantage with respect to Gold, for which alloy components are required in order to achieve lower melting points, is that Bismuth may be used as a non-alloyed (pure) metal. The melting point is relatively low at 271.3° C. Additionally, the vapor pressure for Bismuth prevailing at its melting temperature is lower than for Gold. An additional advantage for consideration is that the ion beam emitted for Gold is mixed with alloy components such as Germanium, so that a stronger requirement for mass filtering results.

The absolute emission beams of $Au_1^+$ and $Bi_1^+$ are approximately equal. Although the atomic, singly charged beam components $Au_1^+$ and $Bi_1^+$ are of comparable value, there is a significant difference in cluster yield. For singly charged ions, the advantage of $Bi_n^+$ with respect to $Au_n^+$ increases linearly with cluster size. Doubly charged cluster ions are emitted only with Bismuth at the nominal intensity.

The cluster components shown in FIG. 2 relate to a total emission current of 1 μA. Since the cluster components are dependent on the emission current, the cluster current may be increased further dependent on other parameters for Bismuth.

Figure 3:
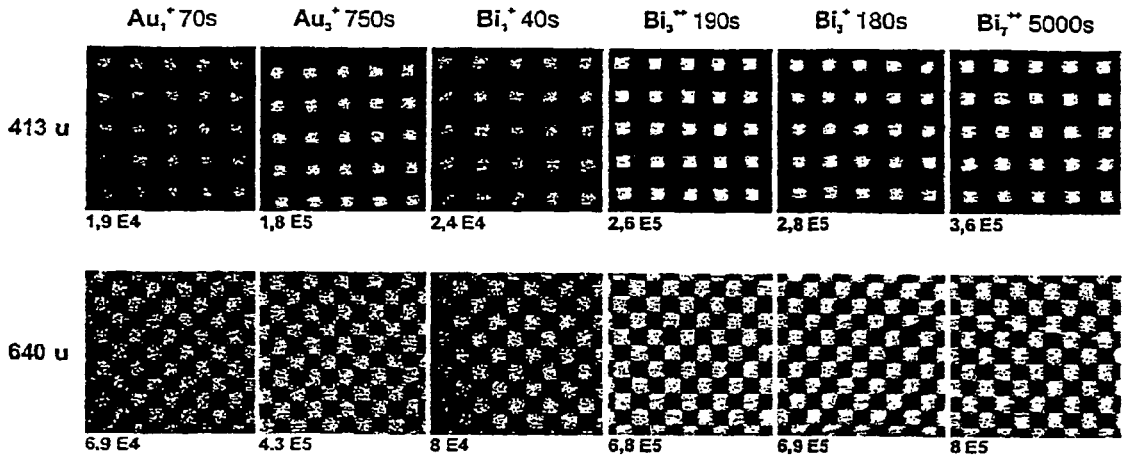
FIG. 3 comprises various photographs of a lateral dye distribution (413*u* and 640*u*) of a color filter array with various primary ion species whereby analysis conditions of 25 keV primary ion energy at a field of view of 50×50 $\mu m^2$ were selected.

In order to compare the invention with the state of the art, identical organic surfaces were analyzed using the same liquid metal ion mass spectrometer and with various types of primary ions (see FIG. 3). The sample was a color filter array such as is positioned before a light-sensitive CCD surface in a digital camera in order to deliver color information. This sample is very well suited for use as a comparison standard since it is produced to be very homogenous and reproducible. Also, the differences achieved between the primary-ion types are completely typical, and may be transferred qualitatively to other molecular hard-body surfaces.

The series of images in FIG. 3 show the lateral distribution of two dyes used with the masses 413*u* and 641*u*. The signal intensity continually decreases because of the increasing destruction of the surface as a result of primary-ion irradiation. The summarized signal intensity is shown for all primary ion species of the above-mentioned type versus equal degree of destruction of the surface (1/e-decrease in signal intensity). The signal intensity achieved is thereby a standard for the efficiency of the analysis.

The very weak $Au_3^+$ cluster beams lead to relatively long measurement times. The use of $Bi_3^+$ clusters allows an increase by a factor of 4 or 5 in primary-ion currents with respect to $Au_3^+$ clusters. Because of the slightly increased yield, the increase in data rates may be even more than this. The 1/e-decrease in signal intensity is achieved with $Au_3^+$ primary ions per 750 s and with $Bi_3^+$ primary ions after a significantly reduced analysis time of 180 s. The reduction in measurement time may largely be traced to the increased $Bi_3^+$ cluster currents. The selection of $Bi_3^{++}$ also leads to similarly reduced measurement time. An increase in efficiency may be achieved by the use of larger clusters such as, for example, $Bi_7^{++}$, but these cluster currents are relatively small, so that analysis times increase overall.

Since the measurement time comprises a significant component of the analysis time, the increase in data rate because of the use of $Bi_3^+$ or $Bi_3^{++}$ leads to a corresponding increased output of samples.

In addition to the above-mentioned advantages as to measurement time, Bismuth emitters also possess advantages, as compared to Gold emitters, relative to emission stability at low emission currents and the mass separation of the types of ions emitted. These advantages lead to the conclusion that Bismuth emitters possess significant economical and technical advantages that might not otherwise be expected.

There has thus been shown and described a novel mass spectrometer and liquid-metal ion source for a mass spectrometer of this type which fulfills all the objects and advantages sought therefor. Many changes, modifications, variations and other uses and applications of the subject invention will, however, become apparent to those skilled in the art after considering this specification and the accompanying drawings which disclose the preferred embodiments thereof. All such changes, modifications, variations and other uses and applications which do not depart from the spirit and scope of the invention are deemed to be covered by the invention, which is to be limited only by the claims which follow.

What is claimed is:

1. In a time-of-flight secondary ion mass spectrometer (TOF-SIMS) for imaging analysis of secondary ions comprising (a) an ion source to create a primary ion beam to irradiate a sample and create secondary ions, said source possessing a heatable ion emitter that is coated in the area exposed to the field with a liquid-metal layer that contains an ionizable metal that is emitted and ionized as the primary ion beam, wherein the primary ion beam contains metal ions with various stages of ionization and cluster statuses, and (b) a spectrometer unit for mass analysis of the secondary ions, the improvement wherein the liquid metal layer is essentially comprised of pure metallic Bismuth or of a low-melting-point alloy containing, in essence, Bismuth; wherein the ion emitter is wettable by such pure metallic Bismuth or such Bismuth alloy; wherein a Bismuth ion mixed beam is emitted by the ion emitter under the influence of an electric field and from which Bismuth ion mixed beam, one of a number of Bismuth ion types whose mass is a multiple of monatomic singly or multiply charged Bismuth ions $Bi_1^{p+}$, is filtered out, using a filtering device, as a mass-pure ion beam that is solely comprised of ions of a type $Bi_n^{p+}$, in which n≥2 and p≥1, and n and p are each a natural number;

whereby $Bi_3$, ion clusters provide a factor of at least four increase in the primary ion current intensity relative to gold cluster ions from a gold liquid metal ion source, leading to a reduction in the TOF-SIMS measurement time.

2. Secondary ion mass spectrometer as in claim 1, wherein the ions filtered out for a mass-pure ion beam belong to one of the following types: $Bi_2^{+}$, $Bi_3^{+}$, $Bi_3^{2+}$, $Bi_4^{+}$, $Bi_5^{30}$ , $Bi_6^{30}$ , $Bi_5^{2+}$, or $Bi_7^{2+}$.

3. Secondary ion mass spectrometer as in claim 1, wherein the secondary ion mass spectrometer may be operated as a flight-time secondary-ion mass spectrometer.

4. Secondary ion mass spectrometer as in claim 1, wherein the emission current of the primary-ion beam during operation is between $10^{-8}$ and $5\times10^{-5}$ A.

5. Secondary ion mass spectrometer as in claim 1, wherein the Bismuth alloy comprises Bismuth and a metal selected from the group consisting of Ni, Ag, Pb, Hg, Cu, Sn, and Zn, whereby an alloy is preferably selected whose melting point lies below that of pure Bismuth.

6. in an ion source to create a primary ion beam to irradiate a sample, and to create secondary ions for a time-of-flight secondary ion mass spectrometer (TOF-SIMS) for imaging analysis of secondary ions, said source possessing a heatable ion emitter that coated in the area exposed to the field with a liquid-metal layer that contains an ionizable metal that is emitted and ionized as the primary ion beam, wherein the primary ion beam contains metal ions with various stages of ionization and cluster statuses, the improvement wherein the liquid metal layer is essentially comprised of pure metallic Bismuth or of a low-melting-point alloy containing Bismuth; wherein the ion emitter is wettable by such pure metallic Bismuth or such Bismuth alloy; wherein a Bismuth ion mixed beam is emitted by the ion emitter under the influence of an electric field, from which Bismuth ion mixed beam, one of a number of Bismuth ion types whose mass is a multiple of monatomic singly or multiply charged Bismuth ions $Bi_1^{p+}$, is filtered out, using a filtering device, as a mass-pure ion beam that is solely comprised of ion clusters of a type $Bi_n^{p+}$, in which n≥2 and p≥1, and n and p are each a natural number;

whereby $Bi_3$ ion clusters provide a factor of at least four increase in the primary ion current intensity relative to gold cluster ions from a gold liquid metal ion source, leading to a reduction in the TOF-SIMS measurement time.

7. Ion source as in claim 6, wherein the Bismuth alloy is coated with one or more metals selected from the group consisting of Ni, Ag, Pb, Hg, Cu, Sn, or Zn, and wherein an alloy is preferably selected whose melting point lies below that of pure Bismuth.

* * * * *